US007073292B1

(12) United States Patent
Minter et al.

(10) Patent No.: US 7,073,292 B1
(45) Date of Patent: Jul. 11, 2006

(54) WINDOW SASH CORNER LOCK

(75) Inventors: Mearl J. Minter, Oskaloosa, IA (US); Todd A. Bernhagen, Pella, IA (US); Brandon N. Pace, Eddyville, IA (US)

(73) Assignee: Pella Corporation, Pella, IA (US)

( * ) Notice: Subject to any disclaimer, the term of this patent is extended or adjusted under 35 U.S.C. 154(b) by 386 days.

(21) Appl. No.: 10/616,807

(22) Filed: Jul. 10, 2003

(51) Int. Cl.
*E05D 15/22* (2006.01)
*E06B 3/96* (2006.01)

(52) U.S. Cl. ..... 49/181; 49/394; 49/446; 52/204.55; 52/656.5; 160/381

(58) Field of Classification Search ..... 52/204.51, 52/204.55, 214, 204.57, 204.58, 204.66, 52/204.68, 285.4, 656.5, 656.7; 49/394, 49/181, 183, 163, 446; 160/381; 403/403; 40/782–785; 292/175
See application file for complete search history.

(56) References Cited

U.S. PATENT DOCUMENTS 1,238,854 A * 9/1917 Watson ..... 49/438
1,241,794 A 10/1917 Watson
1,722,947 A 7/1929 Schneider
4,208,838 A * 6/1980 Kleine et al. ..... 49/192
4,296,587 A * 10/1981 Berdan ..... 52/786.1
4,555,869 A * 12/1985 Kenkel ..... 49/449
4,581,850 A 4/1986 Simpson
4,683,634 A * 8/1987 Cole ..... 29/412
5,450,701 A * 9/1995 White ..... 52/656.9
5,473,853 A * 12/1995 Guillemet et al. ..... 52/745.16
5,609,371 A * 3/1997 Mader et al. ..... 292/164
6,178,696 B1 * 1/2001 Liang ..... 49/185
6,672,365 B1 * 1/2004 Therrien ..... 160/369
6,845,593 B1 * 1/2005 Silverman ..... 52/655.1

* cited by examiner

*Primary Examiner*—Winnie Yip
(74) *Attorney, Agent, or Firm*—Brett Trout

(57) ABSTRACT

An improved window sash assembly which includes a sash held together by corner locks. The corner locks are all of similar construction, but may accommodate either tilt latch mechanisms or pivot terminal mechanisms. By utilizing a single corner bracket for both types of sash connectors, costs can be reduced and efficiencies increased. Additionally, the improved system imparts structural and sealing characteristics to the sash.

17 Claims, 5 Drawing Sheets

WINDOW SASH CORNER LOCK

BACKGROUND OF THE INVENTION

1. Field of the Invention

The present invention relates in general to a corner lock for a window sash and, more specifically, to an improved corner lock system incorporating a corner lock capable of receiving either a pivot terminal or a tilt latch to engage a window frame.

2. Description of the Prior Art

It is well known in the art to provide a window sash with a pair of lower pivot terminals and a pair of upper, retractable latches to allow the sash to move up and down within a window frame, while allowing the upper latches to be retracted and the sash pivoted to allow for cleaning or removal. Such prior art assemblies, however, are expensive and time consuming to produce. Such assemblies typically do not provide substantial support to the sash, and often reduce the integrity of the sash. Furthermore, prior art sash corners must be dedicated to the incorporation of either a retractable latch or a pivot terminal, adding to costs associated with unique tooling and parts associated with each type of assembly.

It is known in the art to provide corner assemblies with extensible pins. Guilemet et al. U.S. Pat. No. 5,473,853 describes a corner lock having a slide member. Such corner locks of the prior art, however, do not work with mitered corners, do not accommodate alternative extensible pins, and would not be adaptable to provide sufficient structural characteristics to window sashes. It would, therefore, be desirable to provide an improved window sash corner lock assembly which would accommodate various types of pins and which would in part improve structural characteristics to the window sash.

It would also be desirable to provide a corner lock assembly which was cost effective and efficient to assemble, which did not reduce the integrity of the sash corner, and which was adaptable to receive either a tilt latch or a pivot terminal. The difficulties encountered in the prior art discussed hereinabove are substantially eliminated by the present invention.

SUMMARY OF THE INVENTION

In an advantage provided by this invention, a corner lock is provided which is adaptable to accommodate either a wash lock or a pivoted terminal.

Advantageously, this invention provides a corner lock and tilt latch assembly which is inexpensive to produce.

Advantageously, this invention provides a corner lock and tilt latch assembly which is easy to assemble.

Advantageously, this invention provides a corner lock and tilt latch assembly which is strong.

Advantageously, this invention provides a corner lock and pivoted terminal assembly which is inexpensive to produce.

Advantageously, this invention provides a corner lock and pivoted terminal assembly which is easy to assembly.

Advantageously, this invention provides a corner lock and pivoted terminal assembly which is strong.

Advantageously, this invention provides a corner lock mechanism which reduces parts and overhead costs associated with assembling tilt latch and pivoted terminal connections in fenestration assemblies.

Advantageously, in a preferred example of this invention, a corner lock is provided having first and second longitudinally extending legs secured to one another. The legs engage interior surfaces of sash members, and at least one of the legs includes a receiver for receiving a rail pin. The rail pin includes a rail engager and means for preventing the rail pin from disengaging from the receiver in either direction. The rail pin extends from the frame and may be provided with either a tilt latch or pivot terminal tip. If the tilt latch is provided, a spring is provided around the rail pin to bias the pin outward. The tilt latch is also provided an operator to force the pin into the frame member.

BRIEF DESCRIPTION OF THE DRAWINGS

The present invention will now be described, by way of example, with reference to the accompanying drawings in which.

DETAILED DESCRIPTION OF THE PREFERRED EMBODIMENT

Figure 1:
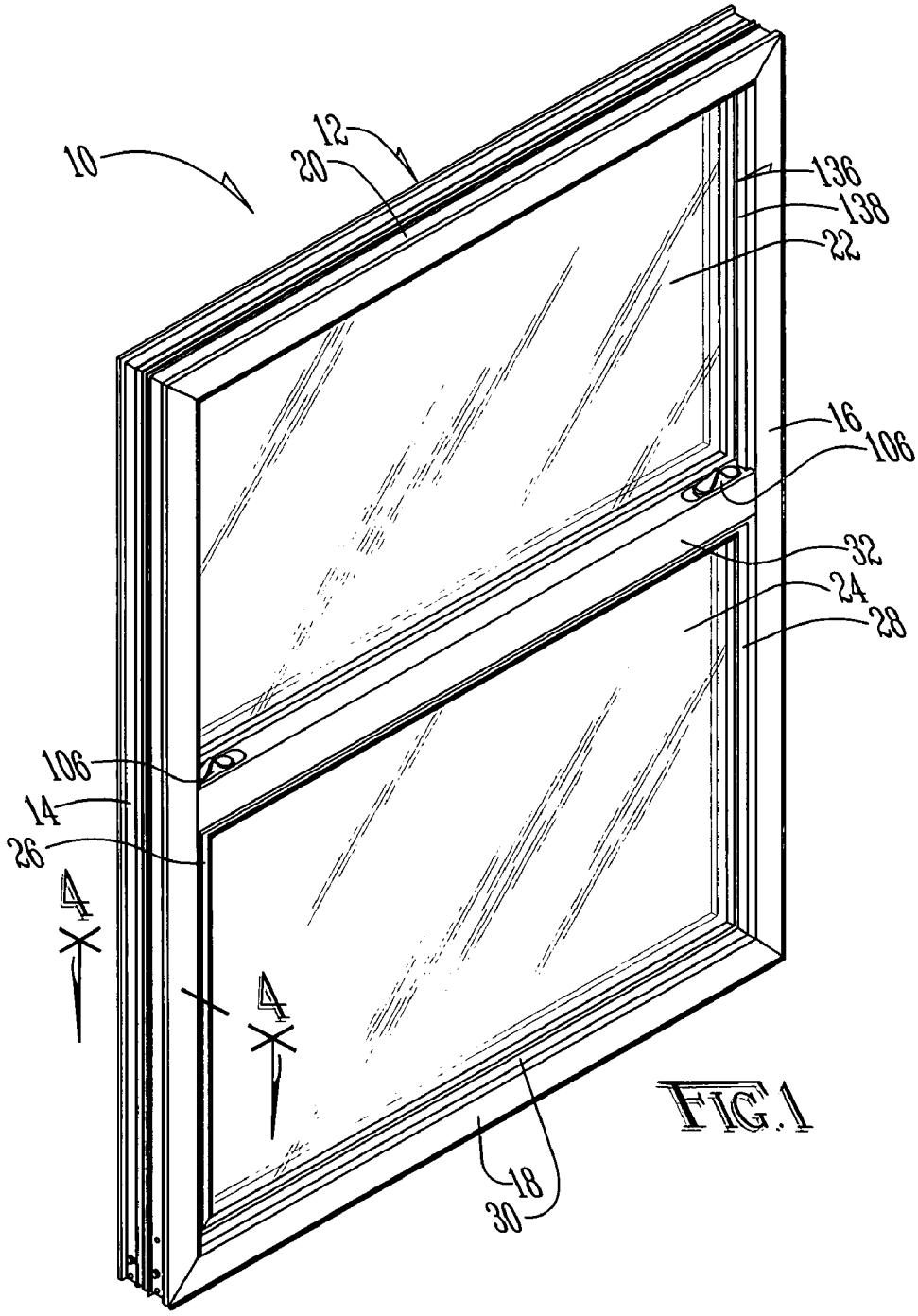
FIG. 1 FIG. 1 illustrates a top perspective view of the improved sash of the present invention.

An improved window according to the present invention is shown generally as (10) in FIG. 1. As shown, the window (10) includes a window frame (12) having a first side jamb (14), a second side jamb (16), a sill (18) and a head jamb (20). Provided within the frame (12) is a first sash (22) and a second sash (24). As the improvement of the present invention may be incorporated into either the first sash (22) or second sash (24), description will be limited to incorporation of the invention into the second sash (24).

Figure 2:
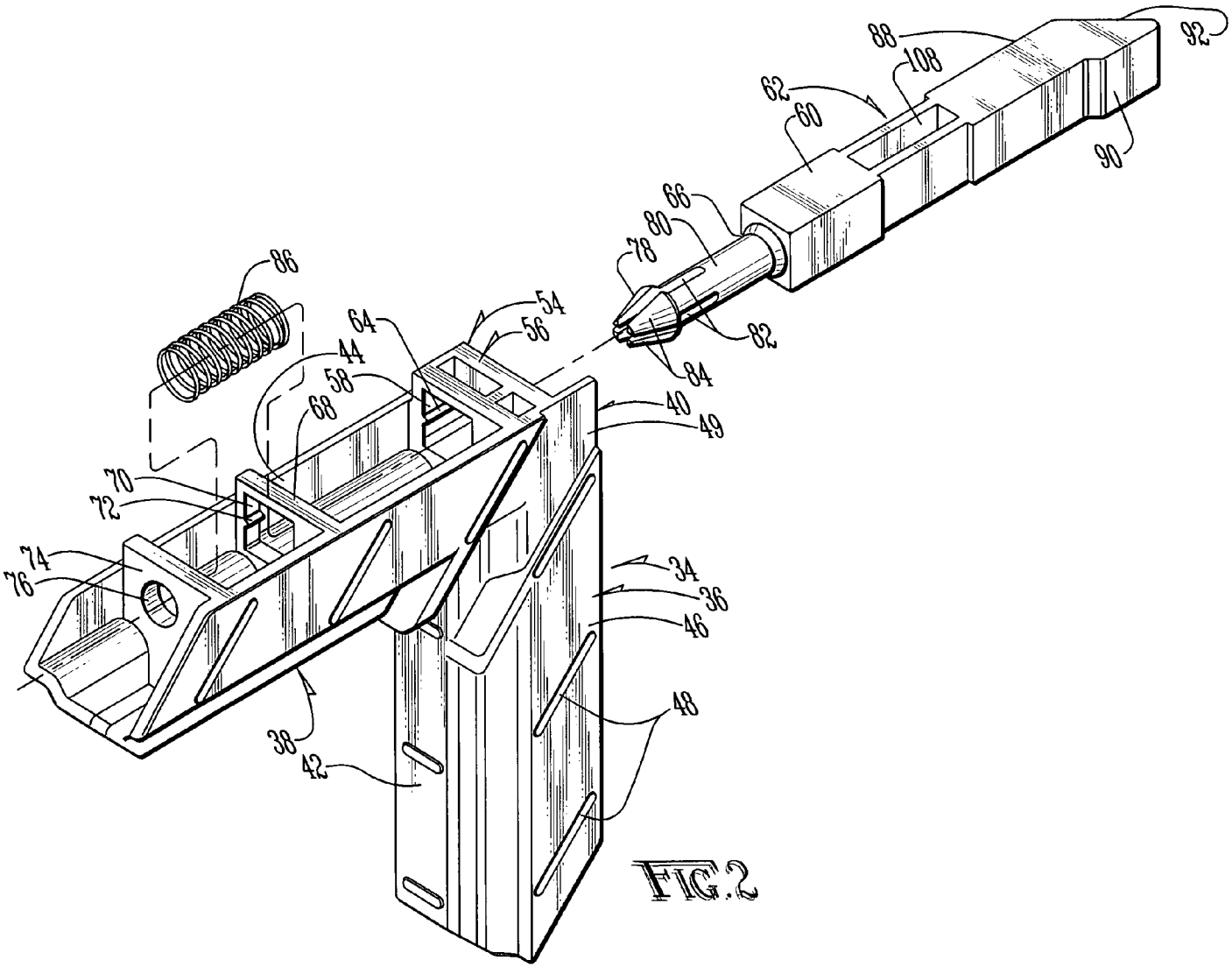
FIG. 2 illustrates a perspective exploded view of the improved tilt latch assembly of the present invention.
Figure 3:
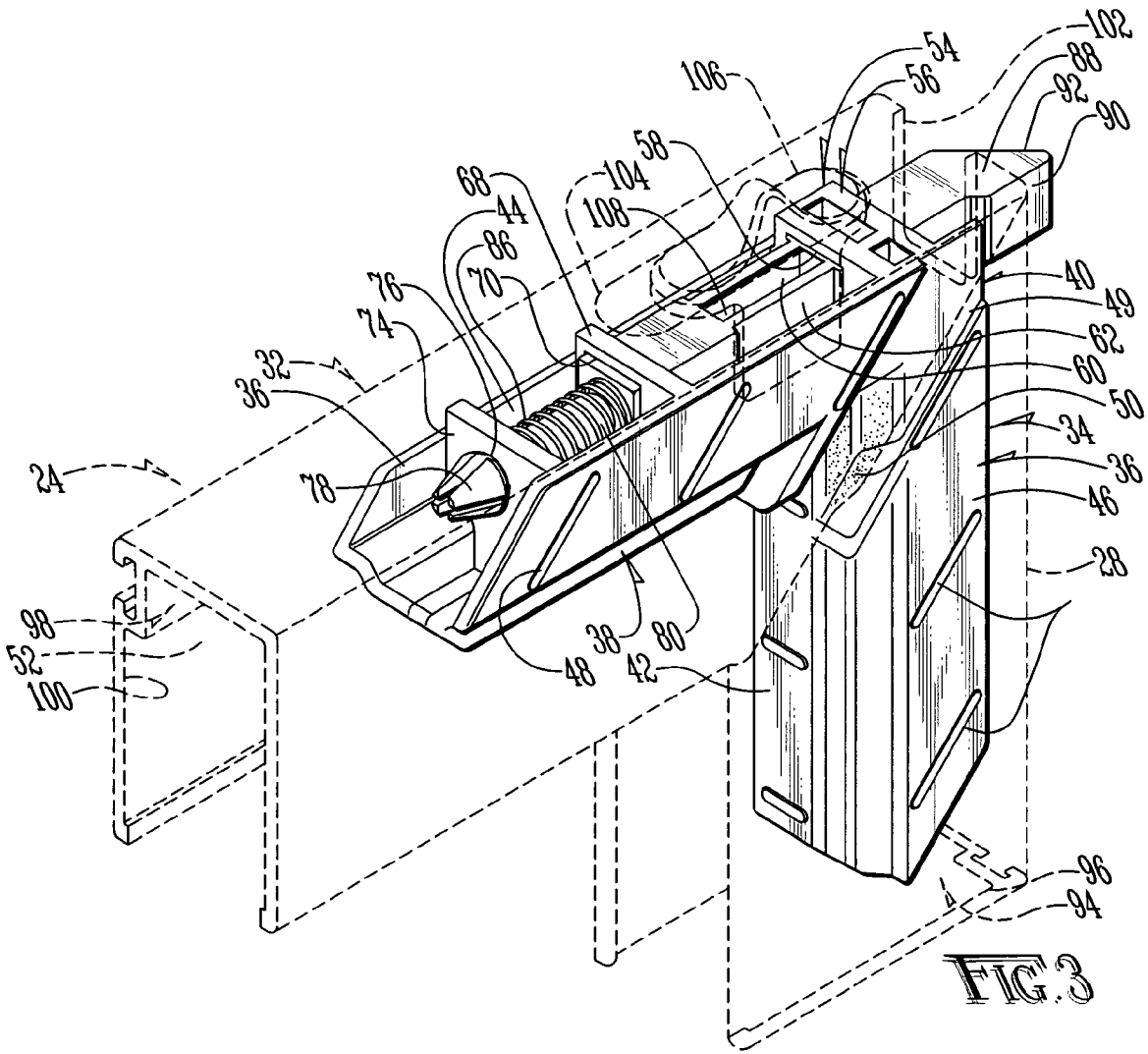
FIG. 3 illustrates a perspective view in partial phantom of the tilt latch assembly of the present invention.

As shown in FIG. 1, the second sash (24) has a first stile (26), a second stile (28), a bottom rail (30) and a top rail (32). The improved corner bracket of the present invention is shown generally as (34) in FIG. 2. The corner bracket (34) is preferably molded of a nylon material but, of course, may be constructed of any suitable material known in the art. As shown in FIG. 2, the corner bracket (34) has a first longitudinally extending leg (36) and a second longitudinally extending leg (38), coupled together by a corner piece (40) integrally molded therewith. The corner bracket (34) is provided with an inward face (42), an outward face (44), and side faces (46). The inward face (42) and side faces (46) are preferably provided with fins (48), which may be of any suitable size and dimensions for the purposes of retaining the corner bracket (34) within the rails (30) and (32), and stiles (26) and (28). The inward face (42) and side faces (46) are also preferably provided with recesses (49) for retaining a sealing material (50), such as a urethane reactive hot melt or similar flowable adhesive, such as those known in the art, between the corner bracket (34) and the interior surfaces (52) of the sash (24). FIGS. 2 and 3. The recesses (49) may be of any suitable dimensions, but are preferably in fluid communication with the lateral and internal abutting edge of the rail (32) and stile (28) within which it is positioned. Accordingly, when the sealing material (50) is injected, as explained more fully below, the sealing material (50) creates a fluid-tight seal along the lateral and internal edges of the rail (32) and stile (28). Preferably, the recesses (49) do not extend along the outer abutting edge of the rail (32) and stile (28). Since the outer abutting edge is typically shielded by the window frame (12), little moisture enters the sash (24). Additionally, since this arrangement allows for the influx and egress of fluid, the sash does not develop pressure as the temperature increases, and any moisture entering the sash (24) simply weeps out from the bottom corners.

As shown in FIG. 2, the outward face (44) of the corner bracket (34) is provided with a pin receiver (54), constructed of a plurality of brackets. The first bracket (56) defines a generally square opening (58) to accommodate the square body (60) of a tilt latch pin (62). The body (60) may be of any dimensions, but is preferably constructed to prevent rotation within the bracket (56). The first bracket (56) is also provided with a nib (64), extending into the opening (58), which engages with a keyway (66) provided on the body (60) of the tilt latch pin (62). The second bracket (68) is provided with a similar opening (70) and nib (72). The second bracket (68) may be of a weaker construction than the first bracket (56), as the first bracket (56) must bear the brunt of force to which the tilt latch pin (62) is subjected.

The third bracket (74) of the pin receiver (54) is provided with a circular opening (76), sized to accommodate a catch (78) and shaft (80) coupled to the body (60) of the tilt latch pin (62). As shown, the catch (78) is preferably of a frusto-conical construction, with a plurality of slits (82) to allow the portions of the catch (78) to resiliently bias away from an orientation in which the pieces touch one another. Accordingly, as the catch (78) moves through the circular opening (76) of the third bracket (74), the pieces (84) of the catch (78) are biased together, thereby decreasing the diameter of the catch (78) and allowing the catch (78) to pass through the circular opening (76) of the third bracket (74). Once the catch (78) has passed through the circular opening (76), the pieces (84) bias toward their original configuration, thereby preventing removal of the catch (78) from the circular opening (76).

Once the tilt latch pin (62) is provided through the opening (58) of the first bracket (56) and opening (70) of the second bracket (68), a coil spring (86) is fitted over the catch (78) and shaft (80) before the catch (78) is passed through the circular opening (76) of the third bracket (74). The coil spring (86) is preferably provided with a diameter larger than the shaft (80), but smaller than the width of the body (60). Accordingly, when the tilt latch pin (62) is properly inserted, the catch (78) prevents the pin (62) from becoming dislodged from the third bracket (74), and the coil spring (86) biases the body (60) of the tilt latch pin (62) away from the coil spring (86).

The tilt latch pin (62) is provided with a tilt latch (88) having a catch (90) and a tapered end (92). As shown in FIG. 3, the first leg (36) of the corner bracket (34) is provided with an interior (94) defined by an interior surface (96) of the second stile (28). Similarly, the first leg (36) is provided within an interior (98) defined by an interior surface (100) of the top rail (32) of the sash (24). The corner bracket (34) and fins (48) attached thereto are sized and dimensioned to snuggly fit the corner bracket (34) within the stile (28) and top rail (32) of the sash (24).

Preferably, the corner bracket (34) is sealed within the sash (24). The corner bracket (34) may either be provided with the sealing material (50) or may, alternatively, be wrapped with a sealing tape, such as that known in the art. The sealing material (50) may be provided around the corner bracket (34) to seal the area between the corner bracket (34) and the interior surfaces (96) and (100) of the sash (24). Alternatively, the sealing material (50) may be injected into the sash (24) around the corner bracket (34) after the corner bracket (34) has been installed in the sash (24). The fins (48) work to retain the corner bracket (34) within the sash (24) and to hold the stile (28) and top rail (32) together, while the recesses (49) act to retain the sealing material (50) between the corner bracket (34) and sash (24).

As shown in FIG. 3, the stile (28) is provided with a slot (102) sized to accommodate the tilt latch pin (62). The top rail (32) is provided with a slot (104) sized to accommodate a molded nylon operator (106), a portion of which is coupled within a well (108) provided in the tilt latch pin (62). The operator (106) preferably rests within the slot (104) which is sized longer than the operator (106) to allow the operator to move relative to the slot (104). The operator (106) allows a user (not shown) to move the tilt latch pin (62) against the bias of the spring (86) to draw the tilt latch pin (62) into the top rail (32). When the operator (106) is released, the spring (86) biases the tilt latch pin (62) toward its original orientation.

Figure 4:
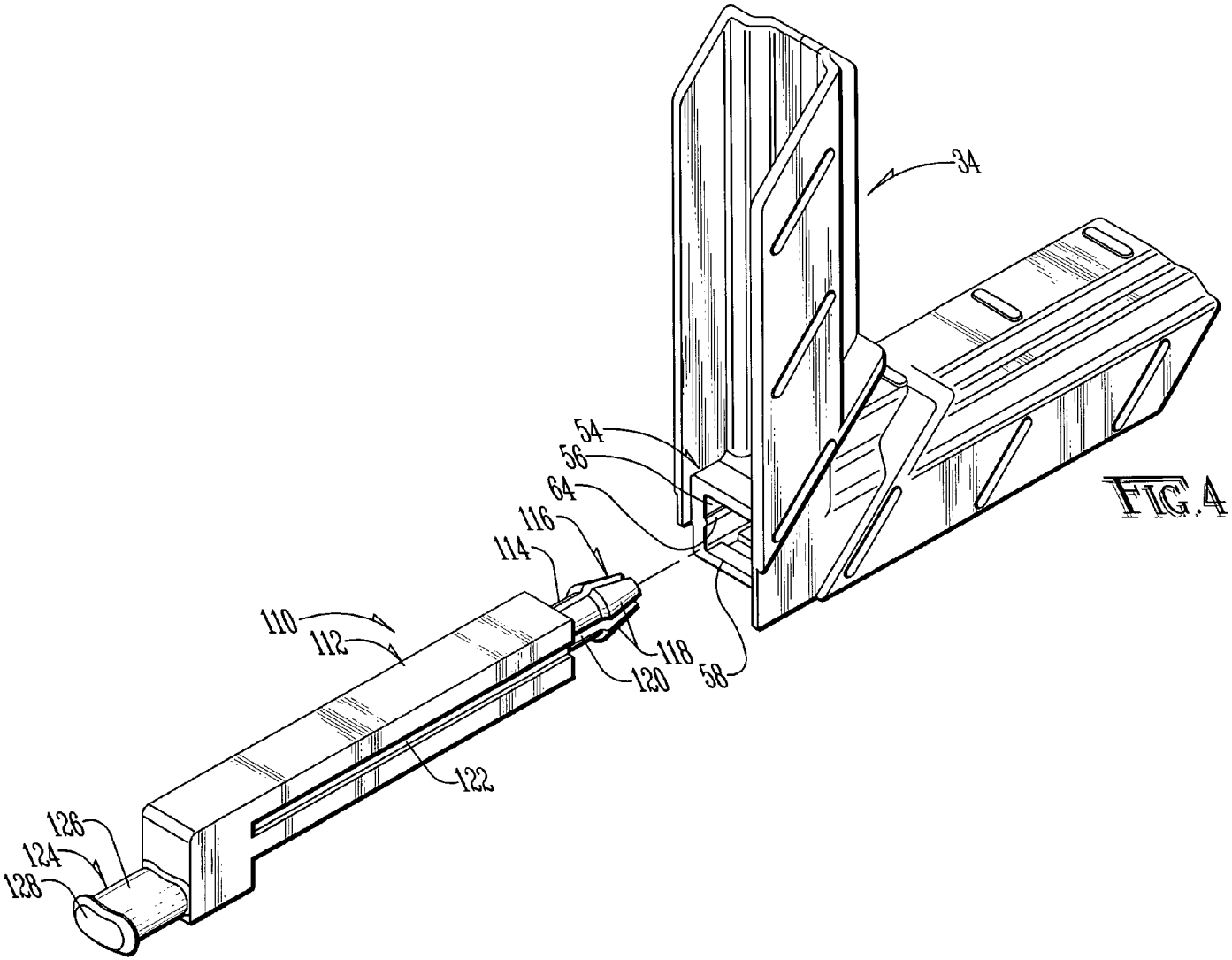
FIG. 4 illustrates a perspective exploded view of the pivot terminal assembly of the present invention.

As shown in FIG. 4, the corner bracket (34) may also be used in association with a pivot terminal pin (110). The pivot terminal pin (110) is also provided with a body (112) and a shaft (114), coupled to a frusto-conical catch (116). As described above, the catch (116) includes a plurality of pieces (118) separated by slots (120), which allow the pieces (118) to be moved toward one another and bias apart. As shown, the body (112) of the pivot terminal pin (110) is much longer, but is still provided with a keyway (122) to coact with the nibs (64) and (72) of the corner bracket (34). The pivot terminal pin (110) is also provided with a pivot terminal (124) having a shaft (126) and a head (128). The head (128) and shaft (126) are preferably of a rounded, rectangular construction, having a width greater than their height.

Figure 5:
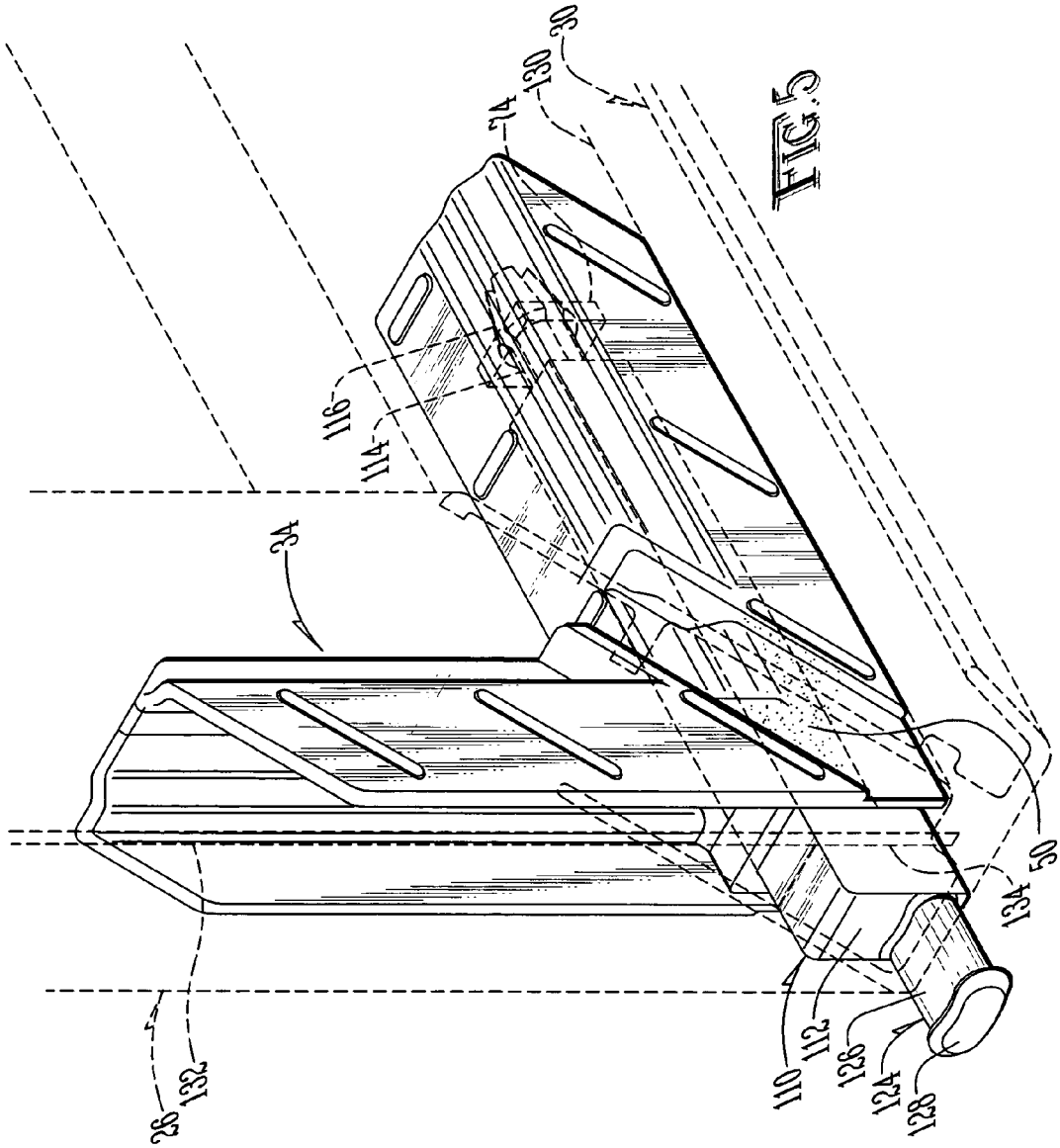
FIG. 5 illustrates a perspective view in partial phantom of the pivot terminal assembly of the present invention.

As shown in FIG. 5, a corner bracket (34) may be inserted into an interior (130) of the bottom rail (30) and an interior (132) of the first stile (26). Once the sealing material (50) has been provided around the corner bracket (34), the pivot terminal pin (110) may be inserted into the corner bracket (34) through a slot (134) provided in the stile (26). The close proximity of the catch (116) to the body (112) of the pivot terminal pin (110) closely matches the width of the third bracket (74), thereby locking the pivot terminal pin (110) in place, once the catch (116) extends through the third bracket (74). This construction prevents the pivot terminal pin (110) from either becoming inadvertently dislodged from the corner bracket (34), or inadvertently becoming introduced further into the bottom rail.

Once the second sash (24) has been provided with four corner brackets (34), two tilt latch pins (62) and two pivot terminal pins (110), the second sash (24) is tilted to place the head (128) of the pivot terminal (124) into a substantial vertical orientation, sufficient to allow the head (128) to fit within a rail (136), such as those known in the art, provided along the frame (12) of the window (10). The rail (136) is provided with overhanging lips (138) to retain the head (128) when the second sash (24) is tilted vertical. Once the head (128) has been positioned within the rail (136), the opposite pivot terminal pin (110) is also provided within a similar rail (136) provided on the opposite side of the frame (112). Once the heads (128) have been so oriented, the second sash (24) is leveled and then tilted upward. As the tapered end (92) of the tilt latch pins (62) come in contact with the frame (12), the taper causes the tilt latch pins (62) to retract into the top rail (32) against the bias of the spring (86). Once the second sash (24) has been tilted into a full, upright position, the spring (86) biases the catch (90) into the rail (136), whereafter the catch (90) prevents the tilt latch pins (62) from becoming inadvertently dislodged from the rail (136).

When it is desired to remove the second sash (24) from the frame (12), the operator (106) is actuated against the bias of the spring (86) to draw the tilt latch pins (62) into the top rail (32) sufficient to allow the catch (90) to pass by the rail (136). The second sash (24) is thereafter tilted outward to a horizontal position, whereafter the second sash (24) is tilted diagonally to dislodge the head (128) of the pivot terminal pin (110) from the rail (136) of the frame (12).

Although the invention has been described with respect to a preferred embodiment thereof, it is also to be understood that it is not to be so limited, since changes and modifications can be made therein which are within the full, intended scope of this invention as defined by the appended claims. For example, it should be noted that the corner bracket (34) may be provided with any means suitable for receiving the pins (62) and (110), and that this invention may be utilized to construct sashes, screens, doors or other frames of any dimension, construction or orientation.

What is claimed is:

1. A corner lock comprising:

(a) a first longitudinally extending leg comprising:
  (i) first means for engaging an interior surface of a first frame member; and
  (ii) a pin receiver comprising:
    a. a first bracket having a generally square slot;
    b. a second bracket having a generally square slot; and
    c. a third bracket having a generally circular slot;
(b) a second longitudinally extending leg comprising second means for engaging an interior surface of a second frame member;
(c) means for securing said first longitudinally extending leg to said second longitudinally extending leg;
(d) a rail pin comprising:
  (i) a rail engager;
  (ii) first means for preventing said rail pin from disengaging from said pin receiver in a first direction; and
  (iii) second means for preventing said rail pin from disengaging from said pin receiver in a second direction, wherein said first direction is substantially opposite said first direction;
(e) wherein said rail pin is slidably received within said pin receiver.

2. The corner lock of claim 1, further comprising means for preventing rotation of said rail pin relative to said pin receiver.

3. The corner lock of claim 1, wherein said first preventing means is a one-way catch.

4. The corner lock of claim 1, wherein said first preventing means is a tapered catch.

5. The corner lock of claim 1, wherein said first preventing means is a resilient conical shaft.

6. The corner lock of claim 5, wherein said second preventing means is a body having a substantially square cross-section having a cross-sectional dimension greater than a diameter of said circular slot.

7. The corner lock of claim 6, further comprising a nib extending into said generally square slot of said first bracket, said nib received within a keyway provided within said body.

8. The corner lock of claim 6, further comprising a shaft coupling said resilient conical shaft to said body.

9. A corner lock comprising:

(a) a first longitudinally extending leg comprising:
  (i) first means for engaging an interior surface of a first frame member; and
  (ii) a pin receiver comprising:
    a. a first bracket having a generally square slot;
    b. a second bracket having a generally square slot; and
    c. a third bracket having a generally circular slot;
(b) a second longitudinally extending leg comprising second means for engaging an interior surface of a second frame member;
(c) means for securing said first longitudinally extending leg to said second longitudinally extending leg;
(d) a rail pin comprising:
  (i) a rail engaging flange;
  (ii) a thick shaft coupled to said flange;
  (iii) a thin shaft coupled to said thick shaft; and
  (iv) a catch provided on said thin shaft;
(e) wherein said rail pin is slidably received within said pin receiver.

10. The corner lock of claim 9, further comprising means for preventing rotation of said rail pin relative to said pin receiver.

11. The corner lock of claim 9, wherein said catch is a resilient cone coupled to said thin shaft.

12. The corner lock of claim 9, further comprising a nib extending into said generally square slot of said first bracket, said nib received within a keyway provided within said thick shaft.

13. The corner lock of claim 9, further comprising a spring provided around said thin shaft.

14. The corner lock of claim 9, further comprising a slider coupled to said rail pin.

15. A window comprising:

(a) a window frame;
(b) sash frame provided within said window frame;
(c) a corner lock provided within said sash, said corner lock comprising:
  (i) a first longitudinally extending leg;
  (ii) a second longitudinally extending leg;
  (iii) means for coupling said first longitudinally extending leg to said second longitudinally extending leg;
  (iv) a first bracket coupled to said first longitudinally extending leg, said first bracket being provided with a first slot;
  (v) a second bracket coupled to said first longitudinally extending leg, said second bracket being provided with a second slot;
  (vi) a pin slidably received through said first slot and said second slot, said pin comprising:
    (a) a rail engager;
    (b) a body;
    (c) a catch;
  (vii) a slider coupled to said body.

16. The window of claim 15, further comprising a first frame member having a first interior and a second frame member having a second interior wherein said first longitudinally extending leg is provided within said first interior and said second longitudinally extending leg is provided within said second interior.

17. The window of claim 16, wherein at least a portion of said slider is located exterior of said first frame member and at least a portion of said rail engager is located exterior of said second frame member.

* * * * *